US005674134A

United States Patent [19]

Blankenship

[11] Patent Number: 5,674,134

[45] Date of Patent: Oct. 7, 1997

[54] GOLF CLUB SHAFT EXTENDER

[76] Inventor: William A. Blankenship, 1306 N. Benson, No. A, Upland, Calif. 91786

[21] Appl. No.: 538,716

[22] Filed: Oct. 3, 1995

[51] Int. Cl.[6] ..... A63B 53/14; A63B 69/36

[52] U.S. Cl. ..... 473/296; 473/316; 473/300

[58] Field of Search ..... 473/282, 288, 473/296, 298, 299, 302, 303, 306, 307, 308, 309, 310, 311, 322, 300, 323, 346, 316, 318, 320, 321, 295, 297; 273/81.2

[56] References Cited

U.S. PATENT DOCUMENTS

| | | | |
|---|---|---|---|
| 1,480,056 | 1/1924 | Flint . | |
| 1,557,156 | 10/1925 | Giess . | |
| 1,573,612 | 2/1926 | Johnston . | |
| 1,652,594 | 12/1927 | Walker . | |
| 1,680,447 | 8/1928 | Bryant . | |
| 1,704,544 | 3/1929 | Novak . | |
| 1,715,586 | 6/1929 | Barkley . | |
| 1,851,439 | 3/1932 | Mattern . | |
| 1,968,616 | 7/1934 | Oldham . | |
| 1,979,430 | 11/1934 | Wright . | |
| 2,464,850 | 3/1949 | Crawshaw . | |
| 2,653,840 | 9/1953 | Bitzer et al. . | |
| 2,704,668 | 3/1955 | Park, Sr. . | |
| 2,781,805 | 2/1957 | Freeman . | |
| 3,070,370 | 12/1962 | Steiner . | |
| 3,539,185 | 11/1970 | Andis . | |
| 3,797,865 | 3/1974 | Ballentine . | |
| 3,809,403 | 5/1974 | Hunter | 473/316 |
| 4,211,415 | 7/1980 | Lindo . | |
| 4,431,187 | 2/1984 | Rumble et al. . | |
| 4,669,726 | 6/1987 | Lempio . | |
| 4,674,747 | 6/1987 | Mazzocco et al. . | |
| 4,746,120 | 5/1988 | Mockovak . | |
| 4,836,545 | 6/1989 | Pompa . | |
| 4,912,836 | 4/1990 | Avetoom . | |
| 4,932,661 | 6/1990 | Choi . | |
| 4,961,576 | 10/1990 | Meredith . | |
| 5,024,438 | 6/1991 | Candow . | |
| 5,042,806 | 8/1991 | Helmstetter . | |
| 5,178,711 | 1/1993 | Lu . | |
| 5,265,872 | 11/1993 | Tennent et al. . | |
| 5,390,921 | 2/1995 | De Ruyter . | |
| 5,454,563 | 10/1995 | Nagamoto . | |

FOREIGN PATENT DOCUMENTS

| | | |
|---|---|---|
| 344625 | 3/1931 | United Kingdom . |

OTHER PUBLICATIONS

"Clubhead & Components Catalog," *Golfsmith*, (month unknown) 1994, p. 173.

"Catalog," *Golfsmith*, (month unknown), p. 165.

"Our 1993 Pledge," *The Golfworks*,(month unknown) 1993, pp. 2–79.

"Catalog," *Dynacraft*, (month unknown) 1995, p. 160.

*Primary Examiner*—Sebastiano Passaniti
*Assistant Examiner*—Steven L. Blau
*Attorney, Agent, or Firm*—Christie, Parker & Hale, LLP

[57] ABSTRACT

A golf shaft extender is glued into the handle end of a golf shaft. The extender has a stepped down portion with at least one type of reinforcement used to reinforce the stepped down portion to prevent breakage at the step down. Specifically, the step down is reinforced with an internal rib, tapered inner wall, greater wall thickness, an external concave fillet radius, a tapered outer wall or some combination thereof. The portion of the golf shaft extender glued into the golf shaft has circumferential grooves intersected by longitudinal grooves to aide the even dispersion of the adhesive.

15 Claims, 5 Drawing Sheets

18
16
29
24
28
14
22
22

GOLF CLUB SHAFT EXTENDER

BACKGROUND OF THE INVENTION

This invention relates to shafts used in athletic equipment.

The sport of golf has become pervasive in our society, and it has reached such a high point of refinement that competitors seek to take advantage of every refinement in golf equipment no matter how small or great the benefit therefrom. Within the last decade, competitors have switched from steel golf shafts as the material of choice to composite shafts including graphite. With the many improvements made to the graphite shaft, competitors are able to use the lower weight composite materials without sacrificing the stiffness, torsion resistance, flex, and feel desired.

A major refinement in golf equipment has been the customization of golf clubs for each individual competitor. One characteristic which is customized is the length of the golf club shaft. The cost of a customized set of clubs, however, is prohibitive for many competitors. To obtain a customized set of clubs at a reasonable cost, competitors can purchase a standard length set of clubs and cut them shorter or extend the shafts with a golf shaft extender to obtain the customized length. If a club is accidently cut too short, a golf shaft extender can be used to lengthen the club and correct the error. Also, if the upper handle of a golf club is damaged, the damaged part of the handle can be cut off, and then a golf shaft extender can be used to restore the golf club to the original length. Further, some competitors use extra long golf clubs to increase club head speed and hence the distance that they can hit a golf ball. Therefore, golf shaft extenders are increasingly being used to customize, repair, and increase the length of golf clubs.

One such extender comprises a solid wooden dowel made from maple or hickory and having a larger diameter portion and a stepped down diameter portion. The stepped down portion is glued into the hollow handle end of a golf club shaft. The wooden extenders provide an extender which is not prone to breaking, but the epoxy used to glue the extender to the shaft does not absorb evenly in the wood and the shaft. Therefore, the adhesive bond between the shaft and the extender can be severed. The wooden extender is also subject to swelling, shrinking, and splitting due to changes in atmospheric conditions which all contribute to separation of the adhesive bond between the extender and the shaft. Further, because the dowel is solid wood, extra weight is added to the shaft.

Another type of extender is hollow and manufactured from graphite. These extenders have a step down insertion portion with circumferential grooves on the step down portion. The insertion portion and the large diameter extension portion have substantially constant wall thickness. The insertion portion is glued into the hollow handle end of a golf club shaft. These types of extenders have been prone to separation from the golf club shaft because of uneven distribution of the adhesive and reduction in gluing surface. Ridges created between the grooves contact the interior wall of the golf club shaft at many points and are so close to the wall at other points that the adhesive cannot be evenly distributed over the gluing surface of the insertion portion. This requires the occasional sanding of large sections of the insertion portion, and if the adhesive is not meticulously applied to assure an even distributing, the adhesive will never be evenly distributed on the insertion portion. More importantly, where the ridges contact the wall of the golf club shaft, there is a loss of gluing surface because no adhesive is interposed between the wall and the extender. All of these factors contribute to failure of the adhesive bond between the extender and the golf club shaft.

The graphite extenders have also demonstrated a propensity to break at the junction between the step down insertion portion and the larger diameter extension portion. The propensity to breakage of these types of extenders has resulted in the removal of some of these extenders from the market and prohibits extension beyond about one inch with this type of extender.

The failure of these extenders and the limitations that they place on the length of extension have reduced the desirability of customizing or elongating clubs with extenders. There is no warning before the separation of the bond between the wooden extender or graphite extender and the golf club shaft, and there is no warning before the graphite extender breaks leaving the competitor without a complete set of clubs.

Thus, reducing the number of extension failures due to the extender breaking or the extender unbonding from the shaft is desirable to enhance the quality of golf clubs and make the use of extensions more feasible. It is also desirable to provide longer extensions to increase the versatility of the extenders. Reduction in the number of extension failures and increase in the length of extensions translate directly into reductions in the cost of extenders and the cost of owning custom golf clubs.

BRIEF SUMMARY OF THE INVENTION

There is, therefore, provided in one embodiment of this invention a novel extender for extending golf shafts and the like. The extender is a tubular member having an extension portion and an insertion portion with a smaller diameter than the extension portion. The insertion portion has external circumferential grooves and at least one external longitudinal extending groove intersecting the circumferential grooves allowing adhesive to flow among the grooves. The strength of the bond between the extender and golf shaft is further increased by maximizing the gluing surface. One way the gluing surface is maximized is by forming the ridges between the grooves so that the ridges do not contact the interior wall of the golf club shaft.

One embodiment of this invention is a tubular golf shaft extender including at least one reinforcement at the step down between the extension portion and the insertion portion. This step down is reinforced by an external concave radius, tapered inner-wall, tapered outer wall increased wall thickness, or a longitudinal rib.

These and other features and advantages of this invention will appear from the following Detailed Description and the accompanying drawings in which similar reference characters denote similar elements throughout the several views.

DETAILED DESCRIPTION

Figure 1:
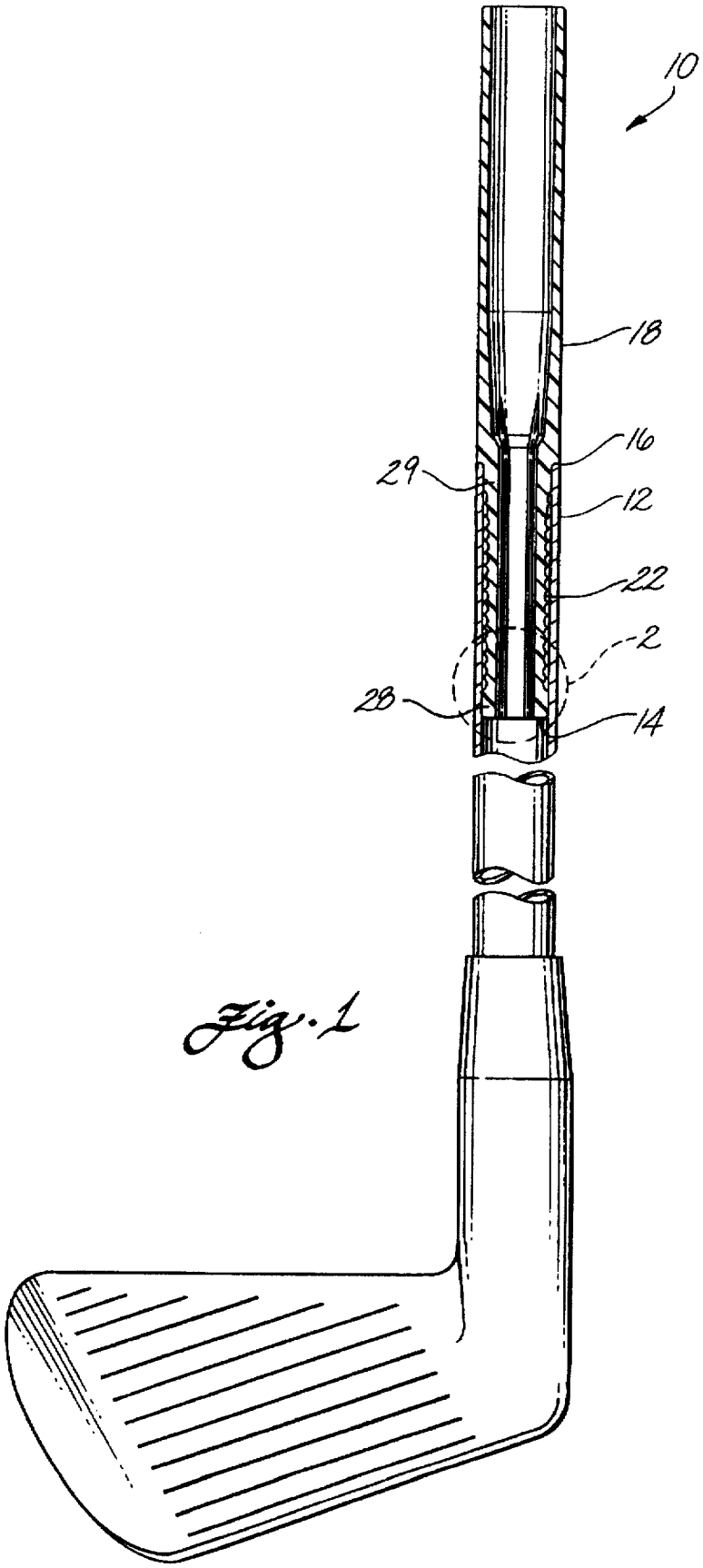
FIG. 1 is an elevational view in partial cross-section of a golf club with a golf shaft extender inserted into the handle of the golf club shaft.
Figure 2:
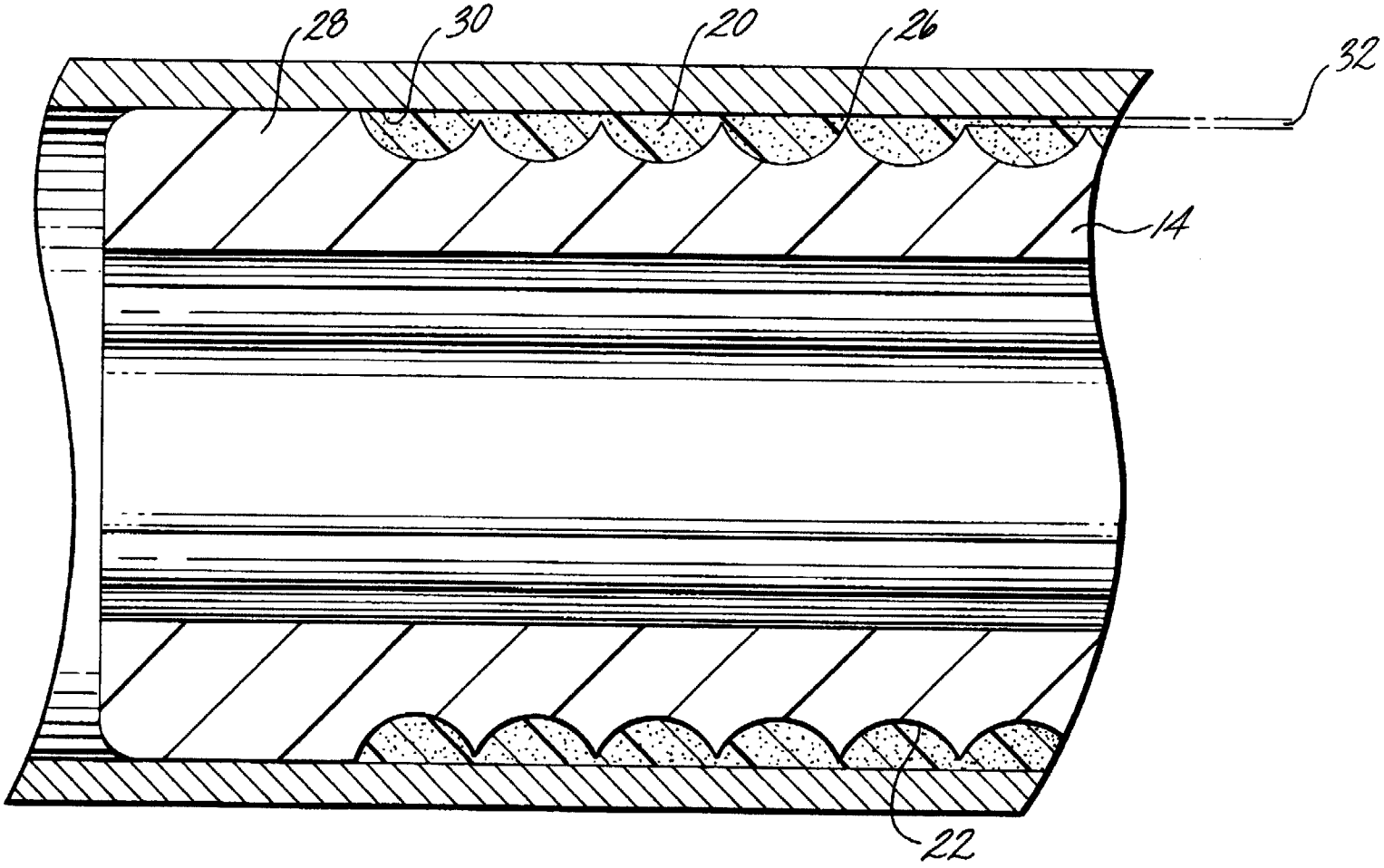
FIG. 2 is an enlarged fragmentary cross-sectional view of the extender of FIG. 1.
Figure 3:
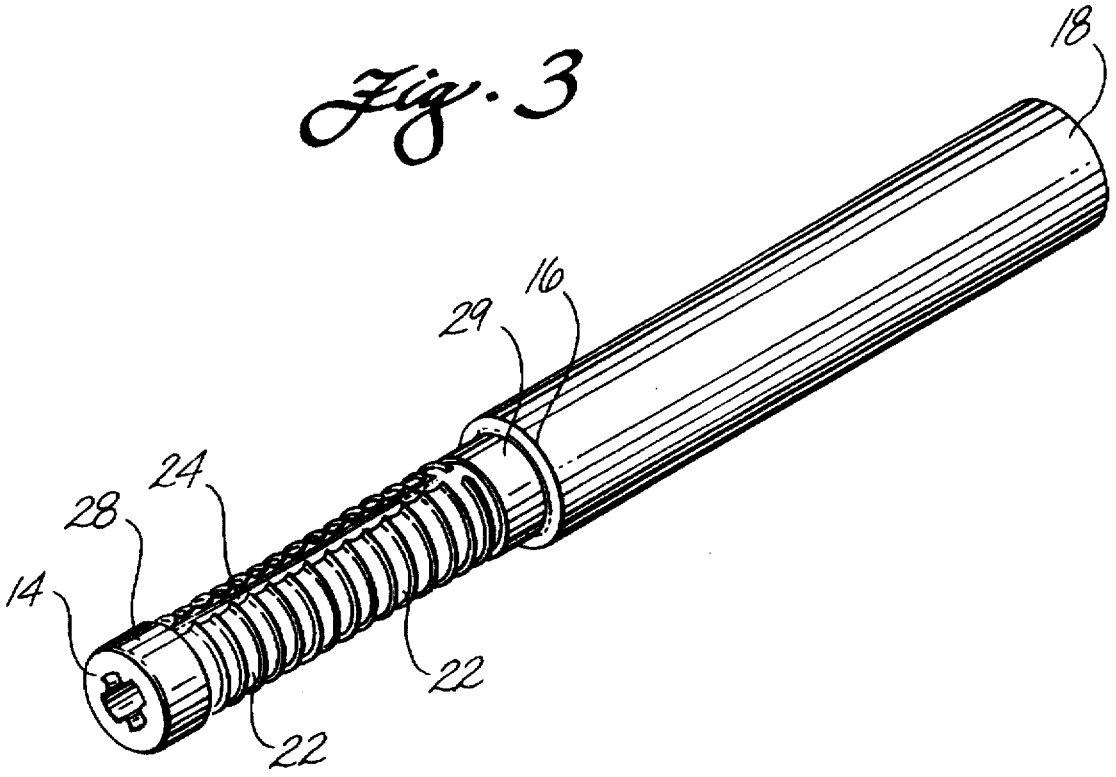
FIG. 3 is a perspective view of the golf shaft extender of FIG. 1.

Turning to the drawings, FIG. 1 shows a golf club with a shaft extender, generally designated 10, inserted into a hollow, handle end 12 of the golf club shaft. With reference to FIGS. 1, 2, and 3 the extender has an insertion portion 14 with an outside diameter which is substantially the same as the inside diameter of the handle of the golf club shaft. The insertion portion is inserted into the handle of the golf club shaft all the way up to a junction 16 between the insertion portion and an extension portion 18. The extension portion has an outer diameter equal to the outer diameter of the handle of the golf club shaft. The insertion portion fits snugly into the handle and is held therein with an adhesive 20.

The adhesive is a high shear strength graphite shafting epoxy such as the epoxy available from GOLFSMITH®. The GOLFSMITH graphite shafting epoxy can be ordered by calling 1-800-456-3344 and referencing stock numbers 9095, 9098, 995, and 996 on page 165 of the 1995 GOLFSMITH catalog. To assure the even distribution of the epoxy, the insertion portion has a plurality of circumferential grooves 22, which allow flow of the epoxy around the circumference of the insertion portion. The insertion portion also has at least one longitudinal groove 24 which transverses the circumferential grooves. The longitudinal groove provides a path for the epoxy to flow longitudinally along the insertion portion out of one circumferential groove and into different circumferential grooves. Thus, the epoxy is free to flow out of a circumferential groove that has too much epoxy into the longitudinal groove, into circumferential grooves without enough epoxy. This network of longitudinal and circumferential grooves assures that even the careless application of the adhesive to the insertion portion will result in the even distribution of the adhesive on the insertion portion. Therefore, the network of longitudinal and circumferential grooves produces a strong bond between the extender and the golf club.

It is a general principle that the strength of the bond between the extender and the golf club increases with the area of gluing surface between the extender and the golf club. To maximize the available gluing surface area, and increase the strength of the bond, the insertion portion has a glue stop tip 28 at the end an upper glue stop 29 at the junction, and a plurality of circumferential ridges 26 formed between the circumferential grooves having a diameter approximately 5/1000 less than the inner diameter of the handle. As shown in FIG. 1, the glue stop tip 28 has a diameter nearly equal to the inner diameter of the handle, and it fits tightly into the handle. Similarly, the upper glue stop 29 has an outer diameter almost equal to the inner diameter of the handle, and it fits tightly into the handle. The tight fit of the upper glue stop prevents adhesive from flowing off the gluing surface area out of the top of the handle. The tight fit of the glue stop tip prevents adhesive from flowing out of the gluing surface area into the golf club shaft. Thus, the adhesive is forced by the glue into the gluing surface area to be distributed by the network of circumferential and longitudinal grooves. The tight fit of both the glue stop tip and upper glue stop also provides proper central alignment of the extender in the handle. It is also desirable to prevent glue from flowing into the golf club shaft because the dried adhesive in the shaft can change the balance and feel of the club. Further, the adhesive can separate from the shaft wall and rattle around in the shaft.

Referring to FIG. 2, the inner wall 30 of the golf club, tightly fits around the tip, but there is a gap 32, illustrated by imaginary lines, between the inner wall 30 and the ridges 26. Therefore, a gluing surface area is provided over the entire length of the insertion portion from the glue stop tip to the upper glue stop 29. Further, the ridges have sharp edges to provide more space for adhesive. This large gluing surface area provides a strong bond between the extender and the handle, which is not likely to separate.

Figure 4:
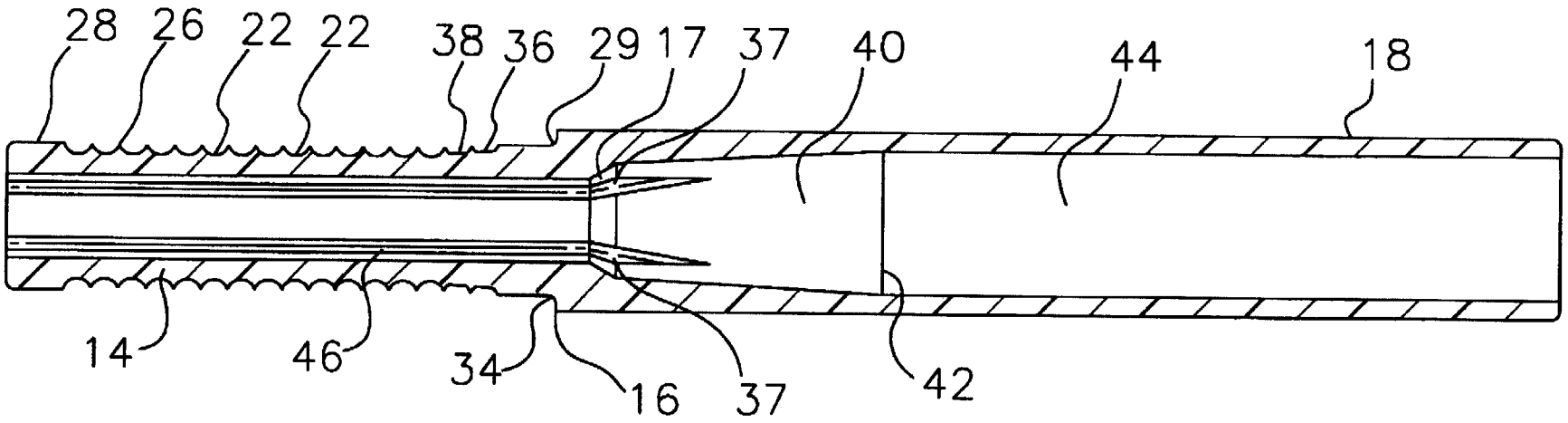
FIG. 4 is a cross-sectional view of the golf shaft extender shown in FIG. 1.

As stated above, current graphite extenders have a tendency to break at the junction 16 between the extension portion and the step down diameter of the insertion portion. To prevent breakage at the junction, several features are incorporated into the golf shaft extender of the current invention as illustrated in FIG. 4. The first feature reinforcing the junction 16 is an external fillet radius 34. Adding the fillet material to the junction fills what would be a sharp corner and prevents stress concentration, a condition occurring in sharp corners, from building up at the junction. The fillet also provides extra material to bear the stresses that must be withstood at the junction.

Figure 5:
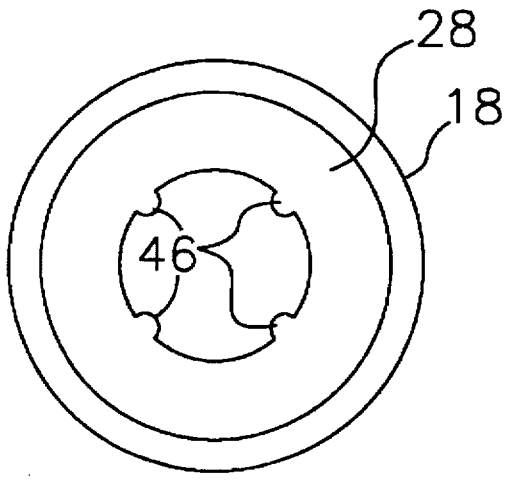
FIG. 5 is an end view from the insertion portion end of the golf shaft extender of FIG. 1.
Figure 6:
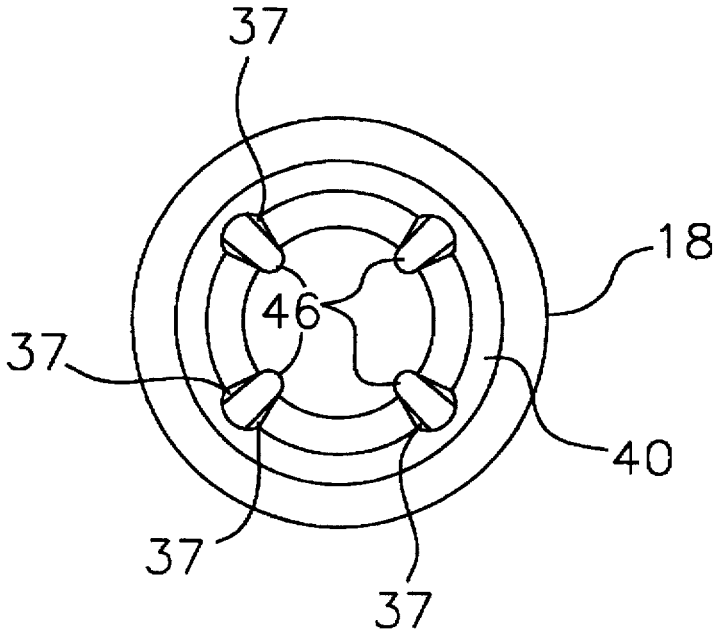
FIG. 6 is an end view from the extension portion end of the golf shaft extender of FIG. 1.

Another feature illustrated in FIGS. 4, 5, and 6, which reinforces the junction, is at least one internal rib 46 which extends from the end of the insertion portion into the extension portion of the extender about ½ inch. Thus, the internal rib extends across the junction between the extension portion and the stepped down insertion portion, thereby reinforcing the junction. The ribs extend radially inward at a constant height through the insertion portion and taper toward the inner wall in the extension portion. Just on the extension side of the junction 16 is a transition section 17., When the ribs pass through the transition section 17, they are taller than at any other point. Further, the ribs have flares 37 in the internal junction. Therefore, the ribs provide extra strength at the junction 16. Because the ribs extend radially inward and are solid as shown in FIG. 3, they are able to withstand the relatively large moments encountered during a swing. The flares provide extra material at the transition section 17 helping to withstand moments and providing more material to withstand the stresses at that point. Four ribs 46 equally spaced around the internal circumference of the extender are preferred because no matter how the extender is inserted into the handle, the ribs will be aligned to withstand the moments encountered during swings. Thus, the four equally spaced ribs provides increased strength and adds minimal weight to the extender. Though the use of four internal ribs is preferred, more or fewer ribs can be used.

Referring again to FIG. 4, the insertion portion has a tapered outer wall reinforcing the junction. The taper is visible in a plurality of the grooves closest to the junction. The circumferential grooves closer to the junction are not as deep. Therefore, there is more material closer to the junction 16, so that the junction is strengthened. In the embodiment shown, circumferential grooves 36 and 38, which are the two circumferential grooves closest to the junction, are not as deep as the other grooves. The groove 36 which is closest to the junction has more material than the groove 38 which is adjacent to the groove 36. Thus, the wall thickness increases in the insertion portion toward the junction 16. A close examination of the two grooves next to the junction reveals that the base of the groove is angled relative to the axis of the extender. Thus, the external wall of the insertion portion is outwardly tapered toward the extension portion. The taper shown in FIG. 4 starts in groove 38 and extends through groove 36, but the taper may start in a circumferential groove which is farther away from the junction 16.

The next feature is an internal tapered wall 40 on the extension portion. The internal wall of the extension portion is inwardly tapered toward the stepped down insertion portion. Thus, the thickness of the extension portion wall increases toward the junction 16. The internal tapered wall starts at the transition section 17 and extends approximately one inch into the extension portion. The degree of taper on the internal wall is kept low so that the tapered wall extends high into the extension portion, and so that the intersection 42 between the internally tapered wall and the remainder of the extension portion 44 is not a sharp corner where stress concentrations can build. The combination of the internal tapered wall 40 and the external tapered wall created by the filled grooves 36 and 38 create an increased wall thickness at the junction 16 without a large addition of weight.

These reinforcement features can be used independently or in conjunction. When used in conjunction, they provide a graphite extender stronger than any previously manufactured graphite extender, including even the wooden extenders. In breakage tests, a maple extender was loaded with successively higher weights at a distance two (2) inches from the golf shaft. The maple extender broke when thirty (30) pounds was loaded onto the extender. Thus, the maple extender withstood sixty (60) inch pounds of torque. A graphite extender without the features of the present invention sold by John Jacobs Golf Clubs of Scottsdale, Ariz. was loaded with successively higher weights at a distance two (2) inches from the golf shaft. The John Jacobs extender fractured when only twenty (20) pounds was loaded on the extender. Thus, the John Jacobs graphite extender withstood forty (40) inch pounds of torque. A graphite extender manufactured with the above reinforcement features was loaded with successively higher weights at a distance 2 and ½ inches away from the golf shaft. The golf shaft extender according to the present invention fractured at twenty-eight (28) pounds. Thus, the golf shaft utilizing the reinforcement features of the present invention withstood seventy (70) inch pounds of torque.

The graphite extender is installed into a golf club shaft by first roughing up the inside of the golf club shaft with a deburring ball or a piece of emery cloth wrapped around a dowel. The fit of the glue stop tip 28 of the extender is then checked in the handle of the golf shaft. If necessary, the tip 28 is circumferentially sanded so that it can fit tightly into the golf club shaft. It is not necessary to sand any of the ridges of the golf shaft extender. After a proper fit is attained between the tip of the extender and the golf club shaft, the above disclosed graphite shafting epoxy should be evenly distributed over the gluing surface area of the insertion portion of the extender. Because of the interaction between the circumferential grooves and the longitudinal grooves, a strong bond between the extender and the golf club shaft will be obtained even if care is not taken to evenly distribute the shafting epoxy over the gluing surface area. Though the tip 28 of the extender will prevent epoxy from flowing into the shaft of the golf club, the epoxy should be allowed to dry with the golf club in an upside down position. That is, the epoxy should be allowed to dry with the head of the golf club directly above the handle. This will help prevent glue from escaping the gluing surface area and flowing into the golf club shaft.

Thus, an improved golf shaft extender having a stepped down portion is disclosed which utilizes an external fillet radius, inner wall taper, outer wall taper internal rib, increased wall thickness, or some combination of these elements to reinforce the junction between the stepped down and stepped up portions thereby more efficiently extending a golf shaft and obtain extension lengths which were before infeasible. Further, the improved golf shaft extender utilizes interconnecting longitudinal and circumferential grooves to more efficiently bond the extender to the golf club shaft by evenly distributing the epoxy on the gluing surface area.

While embodiments and applications of this invention have been shown and described, it would be apparent to those skilled in the art that many more modifications are possible without departing from the inventive concepts herein. These improvements could be applied to other arrangements of extenders. For example, such as the extenders with multiple pieces. A first piece with a constant outer diameter approximately equal to the inner diameter of the golf club shaft could be glued part way into the shaft, and a second piece having an outer diameter nearly equal to the outer diameter of the shaft could fit over the rest of the first piece thereby forming a structure equivalent to that described above. It is, therefore, to be understood that within the scope of the appended claims, this invention may be practiced otherwise than as specifically described.

What is claimed is:

1. A tubular golf shaft extender comprising an extension portion with a diameter, an insertion portion with a stepped down diameter smaller than the diameter of the extension portion, at least one external longitudinally extending groove on the stepped down portion, and a plurality of external circumferential grooves on the stepped down portion intersecting the longitudinal groove whereby the flow of adhesive between and along the grooves is enhanced.

2. The extender of claim 1 wherein the longitudinal grooves are evenly spaced.

3. The extender of claim 1 further comprising a plurality of circumferential ridges and wherein each ridge is formed between a pair of grooves, and the ridges do not contact the golf shaft providing more gluing surface between the golf shaft and extender.

4. The extender of claim 3 wherein the ridges have an outer portion comprising a sharp edge.

5. The extender of claim 1 further comprising an internal wall inwardly tapered toward the stepped down portion, starting in the extension portion and extending up to the stepped down portion, and a substantially untapered external wall such that a wall thickness increases toward the stepped down portion.

6. The extender of claim 1 further comprising at least one solid rib extending longitudinally on the inner wall where the insertion portion and extension portion are joined.

7. The extender of claim 1 wherein each portion has a wall thickness, and further comprising an internally increased wall thickness where the insertion portion and extension portion are joined.

8. The extender of claim 7 further comprising at least one rib extending longitudinally on the inner wall where the insertion portion and extension portions are joined.

9. The extender of claim 1 further comprising at least one solid rib extending longitudinally on the inner wall beginning in the insertion portion and extending into the extension portion.

10. A tubular golf shaft extender comprising an extension portion with a diameter, an insertion portion with a stepped down diameter smaller than the diameter of the extension portion, an internal wall inwardly tapered toward the stepped down portion, starting in the extension portion and extending to the stepped down portion and a substantially untapered external wall such that a wall thickness increases toward the stepped down portion.

11. The extender of claim 10 further comprising at least one solid rib extending longitudinally on the inner wall.

12. The extender of claim 11 further comprising at least one external longitudinally extending groove on the stepped down portion, and a plurality of external circumferential grooves on the stepped down portion intersecting the longitudinal groove whereby the flow of adhesive between and along the circumferential grooves is enhanced.

13. The extender of claim 10 further comprising at least one external longitudinally extending groove on the stepped down portion, and a plurality of external circumferential grooves on the stepped down portion intersecting the longitudinal groove whereby the flow of adhesive between and along the grooves is enhanced.

14. A tubular golf shaft extender comprising an extension portion with a diameter, an insertion portion with a stepped down diameter smaller than the diameter of the extension portion, an internal wall, and at least one solid rib extending longitudinally on the inner wall at the step between the extension portion and the insertion portion, and further comprising at least one external longitudinally extending groove on the stepped down portion, and a plurality of external circumferential grooves on the stepped down portion intersecting the longitudinal groove whereby the flow of adhesive between and along the grooves is enhanced.

15. A tubular golf shaft extender comprising an extension portion with a diameter, an insertion portion with a stepped down diameter smaller than the diameter of the extension portion, an internal wall, and at least one solid rib extending longitudinally on the inner wall at the step between the extension portion and the insertion portion, and wherein the rib traverses the insertion portion and extends into the extension portion.

* * * * *

UNITED STATES PATENT AND TRADEMARK OFFICE

CERTIFICATE OF CORRECTION

PATENT NO. : 5,674,134

DATED : October 7, 1997

INVENTOR(S) : William A. Blankenship

It is certified that error appears in the above-indentified patent and that said Letters Patent is hereby corrected as shown below:

On the title page:

Item [56], References Cited, replace "Catalog," *Golfsmith*, (month unknown), p. 165" with -- Catalog," *Golfsmith*, (month unknown) 1995, p. 165. --

Signed and Sealed this

Eleventh Day of August 1998

Bruce Lehman

*Attest:*

BRUCE LEHMAN

*Attesting Officer*

*Commissioner of Patents and Trademarks*